United States Patent [19]

Kikuchi et al.

[11] Patent Number: 4,676,681

[45] Date of Patent: Jun. 30, 1987

[54] INK RIBBON CASSETTE

[75] Inventors: Hiroshi Kikuchi; Yoshinori Koshida; Takashi Itaya, all of Tokyo, Japan

[73] Assignee: Oki Electric Industry Co., Ltd., Tokyo, Japan

[21] Appl. No.: 748,422

[22] Filed: Jun. 25, 1985

[30] Foreign Application Priority Data

Jun. 25, 1984 [JP] Japan ..... 59-93778[U]

[51] Int. Cl.[4] ..... B41J 35/26; B41J 32/00

[52] U.S. Cl. ..... 400/247; 400/208

[58] Field of Search ..... 400/247, 248, 248.1, 400/208

[56] References Cited

U.S. PATENT DOCUMENTS

| | | | |
|---|---|---|---|
| 4,325,645 | 4/1982 | Miyajima et al. | 400/248 X |
| 4,383,775 | 5/1983 | Trammell et al. | 400/208 |
| 4,408,912 | 10/1983 | Yonkers | 400/248 X |
| 4,422,785 | 12/1983 | Shore | 400/247 X |
| 4,492,484 | 1/1985 | Akazawa et al. | 400/248 |
| 4,496,256 | 1/1985 | McMorrow et al. | 400/248 |

FOREIGN PATENT DOCUMENTS

| | | | |
|---|---|---|---|
| 35967 | 2/1984 | Japan | 400/247 |

OTHER PUBLICATIONS

IBM Tech. Disc. Bulletin, "Print Shield", Coots et al., vol. 18, No. 9, Feb. 1976, pp. 2954–2955.

*Primary Examiner*—Edgar S. Burr
*Assistant Examiner*—James R. McDaniel

[57] ABSTRACT

An ink ribbon cassette has a box-shaped ribbon container for housing an endless ink ribbon and a ribbon protector positioned between a sheet of print paper and the ink ribbon exposed between ribbon guide arms. The ribbon protector is elongate in shape and has a pair of holes defined in the opposite ends thereof and a central hole. The ribbon protector is mounted in position by fitting the end holes thereof over projections on the ribbon guide arms. The ink ribbon cassette also has a pair of holders for preventing the mounted ribbon protector from being detached from the ribbon guide arms. During a printing operation, the ink ribbon is pressed against the sheet by a print head through the central hole in the ribbon protector.

7 Claims, 4 Drawing Figures

INK RIBBON CASSETTE

BACKGROUND OF THE INVENTION

1. Field of the Invention

The present invention relates to an ink ribbon cassette for use in a serial printer.

2. Description of the Related Art

There have heretofore been employed ink ribbon cassettes each comprising an endless ink ribbon housed in a box-shaped cassette, the ink ribbon cassette being mounted on a printer carriage in use. The ink ribbon cassette of this construction is advantageous in that it can easily be installed on the printer carriage, it will not smear the operator's hands and surrounding parts when it is installed on the carriage, and it is small in size. One example of ink ribbon cassette is shown in U.S. Pat. No. 4,383,775.

The known ink ribbon cassette generally has a pair of laterally spaced ribbon guide arms with a space left therebetween for positioning and a print head therein. The endless ribbon accommodated in the ink ribbon cassette runs out of one of the ink ribbon arms and returns into the other ink ribbon arm. During printing, the print head employs an exposed portion of the ink ribbon as it runs between the ribbon guide arms for printing desired characters. Since the ink ribbon is endless, the ink ribbon is fed in circulation to renew the exposed ribbon portion continuously for printing.

When the ink ribbon cassette is installed in the printer, the print head is positioned in the space defined between the ribbon guide arms. In operation, the print head hits the exposed ink ribbon portion to print characters or the like on a sheet of print paper against a platen disposed in confronting relation to the ink ribbon.

If there is an obstruction such as a mass of dust in the print head or on the sheet, then the ink ribbon will tend to sag or the sheet will be likely to be smeared. The ink ribbon may be caught by perforations in the sheet, with the result that the ink ribbon may not be fed smoothly or may be jammed.

One prior solution to the above problem has been to use a ribbon protector between the sheet and the ink ribbon. It has been customary to mount the ribbon protector by fixing it in slits in the ink ribbon cassette or bonding it to the ink ribbon cassette. U.S. Pat. No. 4,383,775 also discloses an ink ribbon cassette with such a ribbon protector.

Where the ribbon protector is fixed to the ink ribbon cassette, the ribbon protector is rendered positionally immovable between the ink ribbon and the sheet, and hence should be positioned highly accurately. Therefore, it has been time-consuming and laborious to mount the ribbon protector on the ink ribbon cassette, and the attached ribbon protector could not easily be replaced with a new one.

SUMMARY OF THE INVENTION

It is an object of the present invention to provide an ink ribbon cassette in which a ribbon protector can easily be mounted and replaced.

Another object of the present invention is to provide an ink ribbon cassette on which it is not required to position a ribbon protector and which has a simple structure by which the ribbon protector is mounted.

Still another object of the present invention is to provide an ink ribbon cassette having a ribbon protector which will not interfere with the printing of a plurality of duplicating sheets or with the travel of the sheets and the ink ribbon.

To achieve the above objects, an ink ribbon cassette according to the present invention includes a pair of ribbon guide arms having respective projections and an elongate ribbon protector made of a resilient material and having a central print hole and a pair of holes defined in opposite ends thereof in registry with the respective projections, at least one of the holes being oblong. The ink ribbon cassette also has holders for preventing the ribbon protector as mounted from being detached.

The holes in the opposite ends of the ribbon protector are fitted respectively over the projections of the ribbon guide arms, and the ribbon protector is supported in position by the holders against detachment from the ribbon guide arms. The central portion of the ribbon protector can freely be moved back and forth because of the oblong hole fitted loosely over the corresponding projection, so that the ribbon protector can automatically be adjusted into an optimum postion between the sheet and the ink ribbon.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
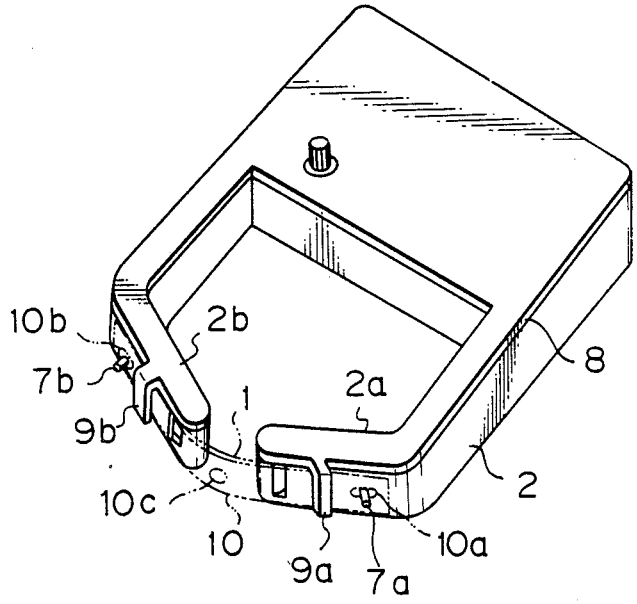
FIG. 1 is a perspective view of an ink ribbon cassette according an embodiment of the present invention.
Figure 2:
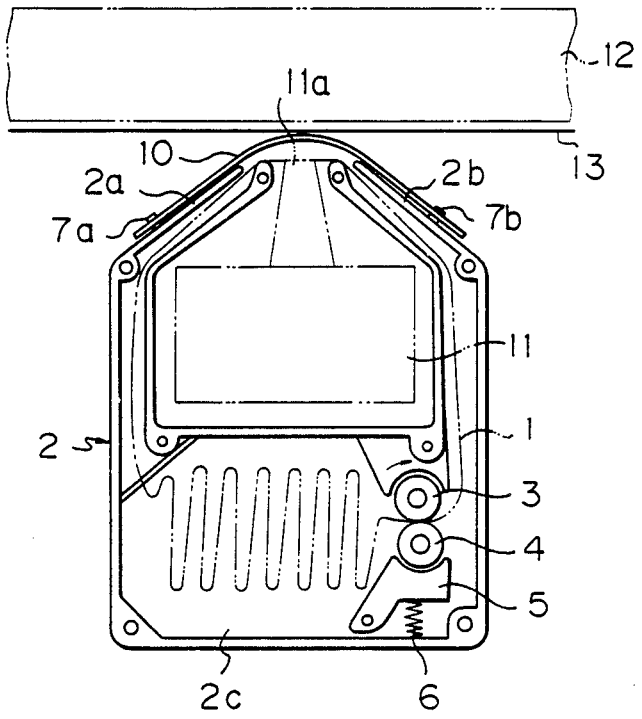
FIG. 2 is a plan view of the ink ribbon cassette shown in FIG. 1 with a cover omitted from illustration.

As shown in FIGS. 1 and 2, an ink ribbon cassette 2 is composed of a ribbon container 2*c* accommodating an endless ink ribbon 1 therein, and a pair of ribbon guide arms 2*a*, 2*b* extending from opposite sides of the ribbon container 2*c* and spaced laterally from each other to provide a gap in which the ink ribbon 1 is exposed. A drive roller 3 is disposed in the ink ribbon cassette 2, and a follower roller 4 is also disposed in the ink ribbon cassette 2 in confronting relation to the drive roller 3.

As shown in FIG. 2, the ink ribbon 1 has a substantial length thereof folded in the ribbon container 2*c*. The ink ribbon 1 is drawn out of the ribbon container 2*c* through ribbon guide arm 2*a* and into the ribbon container 2*c* through the ribbon guide arm 2*b* and between the drive and follower rollers 3, 4, with a portion of the ink ribbon 1 being exposed at all times betwen the ribbon guide arms 2*a*, 2*b*.

The follower roller 4 is movably supported by an angularly movable support member 5 which is normally urged in a direction to press the follower roller 4 against the drive roller 3 under the bias of a spring 6 acting between the support member 5 and the frame of the ink ribbon cassette 2. The ribbon guide arms 2*a*, 2*b* have respective projections or pins 7*a*, 7*b* on their outer surfaces. As shown in FIG. 1, the ink ribbon cassette includes a cover 8 of a shape identical to the ribbon container 2c and the ribbon guide arms 2a, 2b. An elongate ribbon protector 10 made of a resilient material is attached to the ribbon guide arms 2a, 2b. Denoted in FIG. 2 at 11 is a print head, denoted at 12 is a platen, and denoted at is a sheet of print paper.

Figure 3:
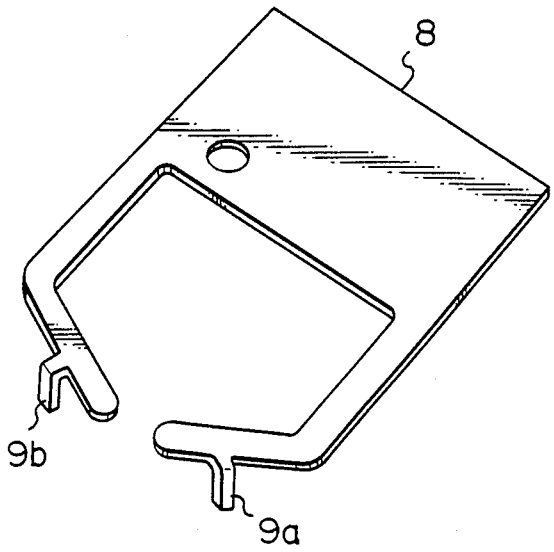
FIG. 3 is a perspective view of a cover of the ink ribbon cassette of the invention.

As illustrated in FIG. 3, the cover 8 includes a pair of arms having a shape identical to the ribbon guide arms 2a, 2b, and having a pair of integral holders 9a, 9b. When the cover 8 is attached to the ribbon container 2c and the ribbon guide arms 2a, 2b the holders 9a, 9b are positioned over the front surfaces of the ribbon guide arms 2a, 2b in a slightly spaced relation thereto so as to extend over the top edge of the ribbon protector 10 and over the front face of the ribbon protector 10, between the exposed portion of the ink ribbon 1 and the projections 7a, 7b.

Figure 4:
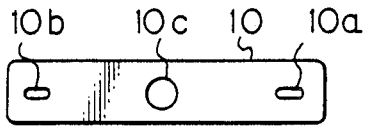
FIG. 4 is a front elevational view of a ribbon protector of the ink ribbon cassette of the present invention.

FIG. 4 shows the ribbon protector 10 which has a pair of oblong holes 10a, 10b defined respectively in the opposite ends thereof, and a central print hole 10c through which a tip and 11a of the print head 11 has access to the sheet 13.

The ribbon protector 10 is mounted on the ribbon guide arms 2a, 2b with the oblong holes 10a, 10b fitted respectively over the projections 7a, 7b on the ribbon guide arms 2a, 2b. At this time, the ribbon protector 10 is supported by the holders 9a, 9b of the cover 8 against detachment from the ribbon cassette 2.

The resilient ribbon protector 10 can be resiliently bent so as to be freely positioned between the ink ribbon 1 and the sheet 13 and thus also can be detached by resiliently bending the ribbon protector forwardly about the holders and off the projections and moved downwardly past the free ends of the holders. Such positional flexibility of the ribbon protector 10 is solely determined by the position of the projections 7a, 7b, the position of the holders 9a, 9b, and the resiliency of the ribbon protector 10. The projections 7a, 7b have a length larger than the space or gap between the ribbon guide arms 2a, 2b and the holders 9a, 9b.

As shown in FIG. 2, the ribbon cassette with the ribbon protector 10 mounted is installed in a printer (not specifically shown). The drive roller 3 in the ribbon cassette 2 is now coupled with the drive source (not shown) in the printer, and the print head 11 is positioned in the space area between the ribbon guide arms 2a, 2b. In a printing operation, the tip end 11a of the print head 11 prints characters on the sheet 13 through the central print hole 10c in the ribbon protector 10. At the same time, the drive roller 3 is rotated in the direction of the arrow and cooperates with the follower roller 4 in drawing the ink ribbon 1 into and out of the ribbon container 2c. The exposed position of the ink ribbon 1 between the ribbon guide arms 2a, 2b is threfore continuously renewed.

The tip end 11a of the print head 11 which is positioned in confronting relation to the exposed ink ribbon 1 between the ribbon guide arms 2a, 2b houses printing wires (not shown) which press the ink ribbon 1 through the central print hole 10c against the sheet 13.

It is known that the distance between the tip end 11a of the print head 11 and the platen 12 is accurately controlled. However, the distance between the ink ribbon 1 and the sheet 13 tends to vary because the ribbon cassette 2 is a molded part and due to slackening and perforations of the sheet 13, and slackening and wrinkles of the ink ribbon 1.

Therefore, the ribbon protector 10 is automatically moved back and forth and positionally adjusted when it engages such slackening portion and perforations of the sheet 13. More specifically, the ribbon protector 10 tends to contact the sheet 13 and the ink ribbon 1 in use. Since the ribbon protector 10 is however resilient, it does not press the sheet 13 too strongly, and hence does not leave any unwanted mark on and obstruct the travel of the sheet 13. The ribbon protector 10 is also prevented from being moved back to the extent which would obstruct the running of the ink ribbon 1.

As a consequence, the ribbon protector 10 is automatically freely movable back and forth to a certain extent between the ink ribbon 1 and the sheet 13.

While in the illustrated embodiment the holders 9a, 9b (FIG. 3) are mounted on the cover 8, they may be mounted on the arms 2a, 2b of the ribbon cassette 2. Although the oblong holes 10a, 10b (FIG. 4) are defined in the opposite end of the ribbon protector 10, an oblong hole may be defined in only one of the ends of the ribbon protector 10.

With the arrangement of the present invention, as described above, the ribbon guide arms of an ink ribbon cassette has projections, and an elongate resilient ribbon protector with holes defined in opposite ends thereof is fitted over the projections and prevented from detachment by holders on the cover of the ink ribbon cassette. The ink ribbon cassette of this construction has the following advantages:

Since the ribbon protector can be mounted on the ink ribbon cassette and replaced in a single operation, it can be installed and detached much more easily than when it is mounted through slits or by adhesive bonding as is conventional. Inasmuch as the mounted ribbon protector is movable back and forth between the sheet and the ink ribbon, it is not necessary to carry out a process for positioning the ribbon protector highly accurately, and the components required are quite simple in structure. The ribbon protector is resiliently capable of following any slackening and perforations of the sheet, and the ribbon protector will not obstruct the printing of the sheet and the travel of the sheet and the ink ribbon. Even when a plurality of sheets are to be printed for duplicating purpose, the ink protector can be resiliently adjusted in position to follow increased slackening and thickness, at perforations, of the sheets.

Although a certain preferred embodiment has been shown and described, it should be understood that many changes and modifications may be made therein without departing from the scope of the appended claims.

What is claimed is:

1. An ink ribbon cassette comprising:

(a) a ribbon container housing an endless ink ribbon therein;

(b) a cover mounted on said ribbon container;

(c) a pair of ribbon guide arms having respective front surfaces, projecting from said ribbon container for guiding said ink ribbon into and out of said ribbon container;

(d) an elongated ribbon protector formed of resiliently bendable material, defined between upper and lower edges thereof detachably mounted on said ribbon guide arms for covering an exposed portion of said ink ribbon between said ribbon guide arms, said ribbon protector having between said upper and lower edges a pair of holes respectively defined in opposite ends thereof and a central hole, said ribbon guide arms having respective projections projecting externally and forwardly thereof, fitted respectively in said pair of holes in said ribbon protector; and (e) means for detachably holding said ribbon protector on said projections, said means including a pair of holders each having a free end and extending over said front surfaces of said ribbon guide arms and extending over only one of said upper edge and said lower edge, and over a face of said ribbon protector to said free end thereof so as to block movement of said ribbon protector away from said front surfaces off of said projections and detachment of said protector from said ribbon guide arms, said ribbon protector being sufficiently resiliently bendable so as to be detachable from said ribbon guide arms by resilient bending movement of said ribbon protector forwardly about said holders and off of said projections and subsequent movement of said ribbon protector in a direction substantially perpendicularly to the direction of said bending movement past said free ends of said holders.

2. An ink ribbon cassette according to claim 1, wherein at least one of said holes in the ends of said ribbon protector is oblong in shape.

3. An ink ribbon cassette according to claim 1, wherein said holders are integrally formed with said cover.

4. An ink ribbon cassette according to claim 1, wherein said projections have a height larger than the space between said ribbon guide arms and said holders.

5. An ink ribbon cassette according to claim 1, wherein said holders are positioned between said projections and said exposed portion of said ink ribbon.

6. An ink ribbon cassette according to claim 1, wherein each of said pair of holders is integrally formed with one of said cover and said respective one of said ribbon guide arms.

7. An ink ribbon cassette according to claim 6, wherein each of said holders consists of an integral member extending over an edge of said ribbon protector and over said face of said ribbon protector in spaced relation to said front surfaces of said ribbon guide arms.

* * * * *